US006758226B2

(12) United States Patent
Porat

(10) Patent No.: US 6,758,226 B2
(45) Date of Patent: Jul. 6, 2004

(54) MOTION DETECTION AND CONTROL FOR AUTOMATED POOL CLEANER

(75) Inventor: Joseph Porat, North Coldwell, NJ (US)

(73) Assignee: Aqua Products Inc., Cedar Grove, NJ (US)

( * ) Notice: Subject to any disclaimer, the term of this patent is extended or adjusted under 35 U.S.C. 154(b) by 270 days.

(21) Appl. No.: 09/910,184

(22) Filed: Jul. 20, 2001

(65) Prior Publication Data

US 2001/0050093 A1 Dec. 13, 2001

Related U.S. Application Data

(63) Continuation-in-part of application No. 09/285,020, filed on Apr. 1, 1999, now Pat. No. 6,299,699.

(51) Int. Cl.[7] ..... B09B 3/02

(52) U.S. Cl. ..... 134/56 R; 134/58 R; 134/172; 134/166 R; 134/167 R; 15/1.7

(58) Field of Search ..... 15/1.7; 134/56 R, 134/57 R, 58 R, 172, 198, 166 R, 167 R

(56) References Cited

U.S. PATENT DOCUMENTS

| | | | | |
|---|---|---|---|---|
| 331,805 | A | * | 12/1885 | Petersen |
| 1,487,953 | A | * | 3/1924 | Kissinger |
| 2,988,762 | A | * | 6/1961 | Babcock |
| 3,229,315 | A | * | 1/1966 | Watson |
| 3,551,930 | A | * | 1/1971 | Myers |
| 3,676,884 | A | * | 7/1972 | Wulc |
| 3,688,410 | A | * | 9/1972 | Zeidler et al. |
| 3,860,518 | A | * | 1/1975 | Henricksen |
| 3,979,788 | A | * | 9/1976 | Strausak |
| 4,100,641 | A | * | 7/1978 | Panii |
| 4,259,918 | A | * | 4/1981 | Ward et al. |
| 4,518,437 | A | * | 5/1985 | Sommer |
| 4,786,334 | A | * | 11/1988 | Nystrom |
| 4,920,599 | A | * | 5/1990 | Rief |
| 5,128,031 | A | * | 7/1992 | Midkiff |
| 5,197,158 | A | * | 3/1993 | Moini |
| 5,220,731 | A | * | 6/1993 | Waclawik et al. |
| 5,256,207 | A | * | 10/1993 | Sommer |
| 5,337,434 | A | * | 8/1994 | Erlich |
| 5,435,031 | A | * | 7/1995 | Minami et al. |
| 5,725,761 | A | * | 3/1998 | Phillips |
| 6,115,864 | A | * | 9/2000 | Davidsoon et al. |
| 6,412,133 | B1 | * | 7/2002 | Erlich et al. |

FOREIGN PATENT DOCUMENTS

| | | | |
|---|---|---|---|
| JP | 54-56251 | * | 5/1979 |

* cited by examiner

*Primary Examiner*—Frankie L. Stinson
(74) *Attorney, Agent, or Firm*—Abelman, Frayne & Schwab

(57) ABSTRACT

An automated power-driven pool cleaning apparatus is provided with a motion translating member that contacts the surface being cleaned, an associated signal transmitter and a sensor that is connected to the pool cleaner's programmed electronic control device, or chip, so that when the cleaner is moving, the mtm moves the signal transmitter past the sensor thereby providing an intermittent signal. When the cleaner stops moving, no intermittent signal is received and after a predetermined period of time, the control device causes the cleaner's drive means to move the cleaner in a different direction.

27 Claims, 5 Drawing Sheets

FIG. 3
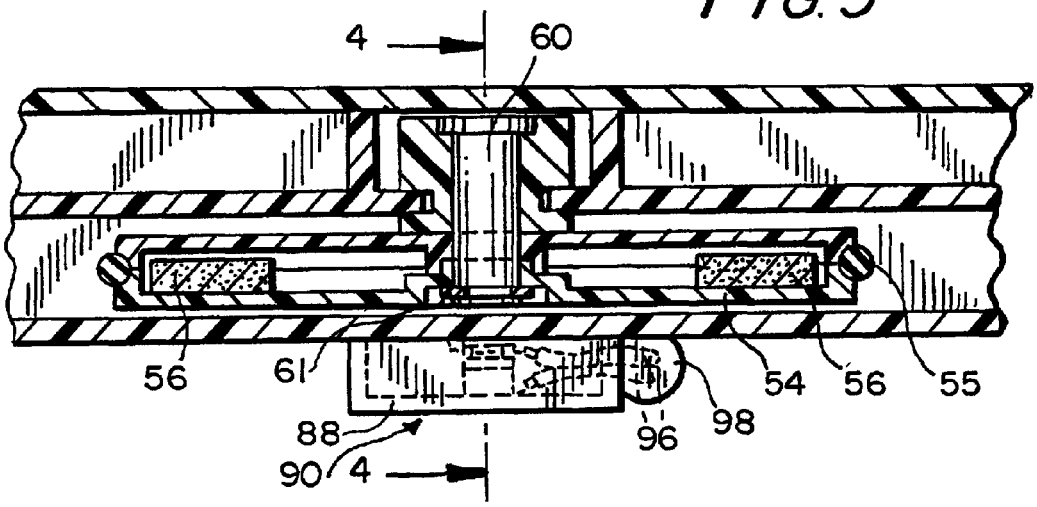
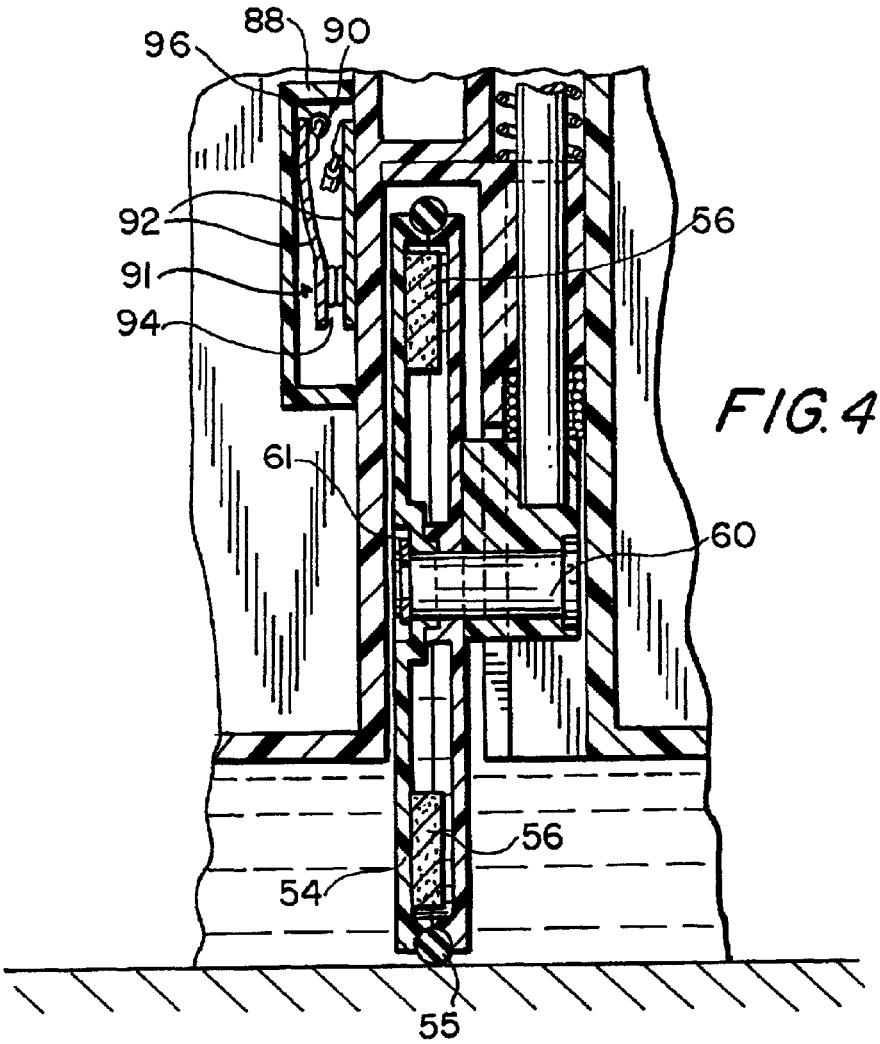
FIG. 4

MOTION DETECTION AND CONTROL FOR AUTOMATED POOL CLEANER

This application is a continuation-in-part of U.S. Ser. No. 09/285,020 filed Apr. 1, 1999, now U.S. Pat. No. 6,299,699.

FIELD OF THE INVENTION

The invention relates to motion detection and control systems for automated, power-driven pool and tank cleaning apparatus.

BACKGROUND OF THE INVENTION

Automated, power-driven pool and tank cleaners have been provided with programmable circuit control devices to provide random and/or regular patterns of movement of the apparatus. The purpose of these devices is to maximize the probability that the apparatus will cover the entire bottom wall surface during the cleaning operation. Some pool cleaners are designed and programmed accordingly for cleaning the generally vertical side walls, as well as the bottom wall of the pool or tank.

Control devices are known that produce a change in direction after a predetermined period of time. Other control devices respond to signals generated by mercury switches that change with the orientation from horizontal to vertical, or when a projecting rod, proximity device, or the like senses that the apparatus is adjacent a wall.

These prior art methods and apparatus for controlling the direction of movement do not take into account the possibility that the apparatus may be stopped by an obstacle, or that much of the directional cycle may be spent with the apparatus stalled in a corner or other pool contour.

It is therefore an object of this invention to provide a method and apparatus for determining whether the apparatus is actually moving across a wall surface that is to be cleaned or whether the relative movement of the apparatus has stopped and, in the event that relative movement has ceased, to thereafter cause the apparatus drive means to move the apparatus in a different direction.

It is a further object of the invention to provide a method and apparatus for detecting the relative motion of the apparatus that are responsive to changes in the contour of the surface being cleaned.

SUMMARY OF THE INVENTION

The above objects and other advantages are obtained by the method and apparatus of the invention which comprehends providing an automated power-driven pool cleaning apparatus which includes a programmable control device for directing the movement of the apparatus with elements comprising:

- a motion translating member ("mtm") mounted for contacting the surface of the wall being cleaned, said motion translating member moving as said apparatus moves across the wall;
- a signal transmitter for transmitting signals in accordance with movement of said motion translating member; and
- a sensor mounted to receive signals from said signal transmitter and for providing an output indicative of signals received to the control device,
- wherein the programmable control device is programmed to alter the direction of movement of said apparatus when the output of said sensor indicates that said apparatus has not moved within a prescribed period of time.

In accordance with the method of the invention for controlling movement of an automated power-driven pool cleaning apparatus, the apparatus comprising a programmable control device for directing movement of the apparatus, the method comprising the steps of:

- providing a motion translating member mounted on the apparatus for contacting the surface of the wall being cleaned, the motion translating member including at least one signal transmitter that moves as the apparatus moves across the wall;
- providing a sensor mounted on the apparatus to receive signals from the signal transmitter;
- transmitting signals from the signal transmitter in relative to the accordance with movement of the motion translating member;
- outputting from the sensor to the programmable control device, an output signal that is indicative of signals received from the signal transmitter by the sensor; and
- changing a direction of movement of the apparatus under control of the programmable control device when the output indicates that the apparatus has not moved within a prescribed period of time.

The motion translating member can take the form of a wheel, a continuous belt or other element that extends from the body of the pool cleaner apparatus to contact the wall that is being cleaned. The mtm is mounted so that it moves freely as the apparatus traverses the bottom and/or side walls of the pool. The mtm stops moving when the apparatus stops moving, e.g., when the apparatus encounters an obstacle, a vertical sidewall (if the cleaner is designed only to clean the bottom wall), or the surface of the water when on a side wall. As will be explained in more detail below, when the mtm stops for a pre-determined period of time, an associated signal transmitter ceases to transmit an intermittent signal to a nearby sensor, and the program of the electronic control device causes the drive means to stop and then to reverse the direction of the cleaner.

The mtm is preferably mounted to extend downwardly beneath the body of the cleaner, between the drive means and in a position where it is protected from side impact.

The mtm can be in the form of a wheel that is mounted on an axle, which in turn is mounted for vertical displacement in response to a biasing force that urges the mtm into contact with the wall below the apparatus. Thus, the portion of the mtm in contact with the wall moves in response to depressions, e.g., recessed drains, or to raised areas and other irregularities typically found on the walls of a pool and which do not impede the progress of the apparatus in the pursuit of its cleaning program.

The mtm can take the form of an endless belt or track, one or more of the supporting pulleys or sprockets of which is mounted as described above to assure that the portion of the belt extending below the apparatus maintains contact with the surface being cleaned. The mechanism for this embodiment can include one or more idler rollers to provide the necessary tension and expansion for the belt.

The mtm is provided with at least one signal transmitter that is mounted for movement with the mtm. The signal transmitter can take the form of one or more permanent magnets, each of which emanates a separate magnetic force field; a point source of light; one or more apertures that permit the passage of light from a fixed light source adjacent the mtm; or other equivalent devices which will be apparent to those of ordinary skill in the signal generation, control and detection art.

A sensor is positioned proximate the mtm to receive and respond to the signal from the transmitter. The sensor is also in communication with the programmed control device. In a preferred embodiment, the sensor is hard-wired to the device. However, infrared and short range radio transmission technology can be utilized to link the sensor and the control device.

When the apparatus is moving, one or more signal transmitters mounted in the mtm will provide an intermittent signal to the sensor as it moves past the sensor. In turn, the sensor communicates this data to the control device. When the apparatus stops, as by having its movement interrupted by an obstacle, no intermittent signal is received by the sensor. After a prescribed period of time, the control device program causes the drive means to reverse or otherwise change the direction of movement of the apparatus.

The control device is programmed to process a continuous signal from the transmitter to the sensor in the same manner as no signal. Thus, if the mtm stops so that a magnet, or light source, or light-transmitting aperture is providing a continuous signal to the sensor for more than the predetermined interval, the apparatus will be reversed.

The use of the apparatus and method of the invention provides an inexpensive and reliable solution to the problem of maintaining a continuous pattern of movement for the apparatus. Placement of the mtm inboard and beneath the body of the cleaner minimizes its exposure to damaging impacts, both in and out of the pool. The number of moving parts is minimal, their assembly and mode of operation is straight-forward, and they can be made from known materials to assure long-term use without failure.

BRIEF DESCRIPTION OF THE DRAWINGS

The above objects and other advantages will become apparent from the detailed description of the invention, particularly when read in conjunction with the attached drawings in which like elements are referred to by the same numeral and where

FIG. 3 is a bottom sectional view taken along section line 3—3 of FIG. 2;

FIG. 4 is a sectional end view taken along section line 4—4 of FIG. 3;

Preferred embodiments of the invention will be described with reference to the attached drawings in which FIG. 1 is a plan view of swimming pool 1 having a bottom wall 2 and side walls 4, across which is moving a power-driven, automated pool cleaner referred to generally as 10. Pool cleaner power cord 12 provides a low voltage current from a remote power source (not shown) to power the drive means contained in housing 14 that move drive means 16 attached to cleaning brushes 18 that contact the wall surface of the pool being cleaned. The pool cleaning apparatus 10 also includes a programmable control device, i.e., a computer chip, which is pre-programmed with a routine for controlling the drive means to accomplish a predetermined pattern of movement that is intended to clean the entire bottom wall surface, as well as the side walls if the apparatus is so designed and constructed. For the purpose of this description, the embodiment will be limited generally to a pool cleaner that is adapted to cleaning the bottom wall of a pool or tank. The design and manufacture of the programmable control device for the pool cleaning apparatus is within the skill of the art.

DESCRIPTION OF PREFERRED EMBODIMENTS

As noted above, the pool cleaner 10 moves in a pattern under the control of a programmable control device, such as a computer chip, which directs its movement across the bottom and/or side walls of the pool or tank. The control device itself is conventional, but it receives specified signals and is programmed to respond thereto in accordance with the present invention to achieve new and unobvious results. In particular, the mtm is provided with means for indicating to the control device both when the mtm, and hence the pool cleaner 10, is moving normally, i.e. as intended, and also when the pool cleaner 10 has not moved for at least a prescribed period of time. Accordingly, when the pool cleaner 10 has stopped, e.g., against a side wall, or when it should not have stopped, e.g., against an obstacle, the control device can take action by changing the direction of movement of the pool cleaner 10 to get it moving again.

Figure 1:
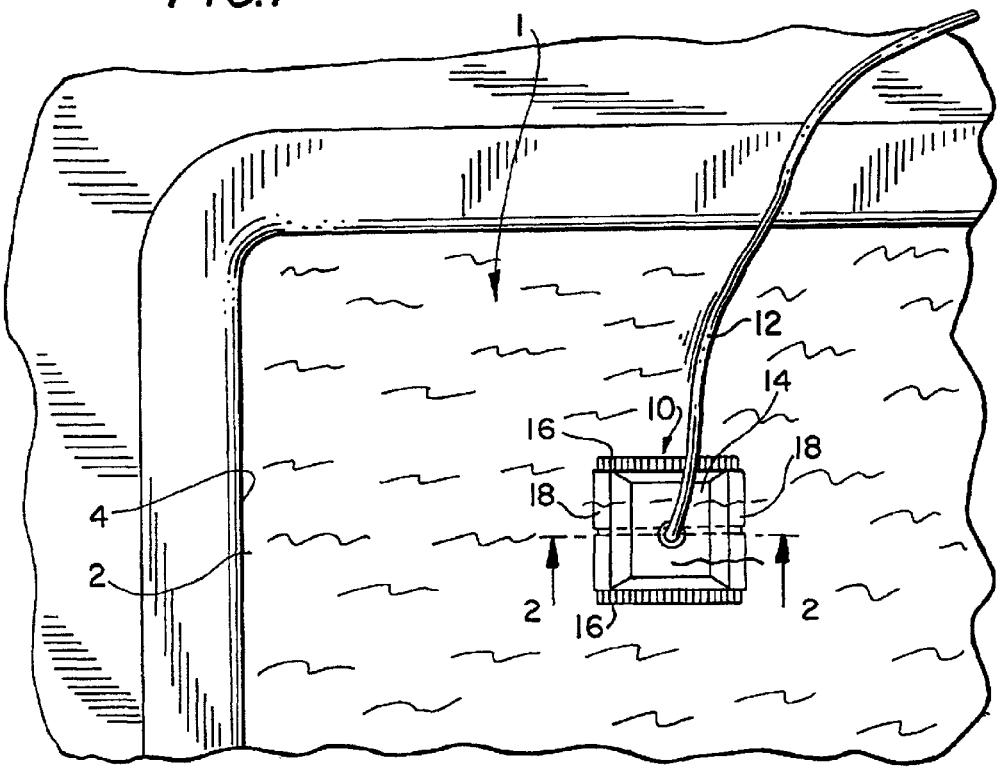
FIG. 1 is a top plan view of a portion of a pool in which a pool cleaner is operating.
Figure 2:
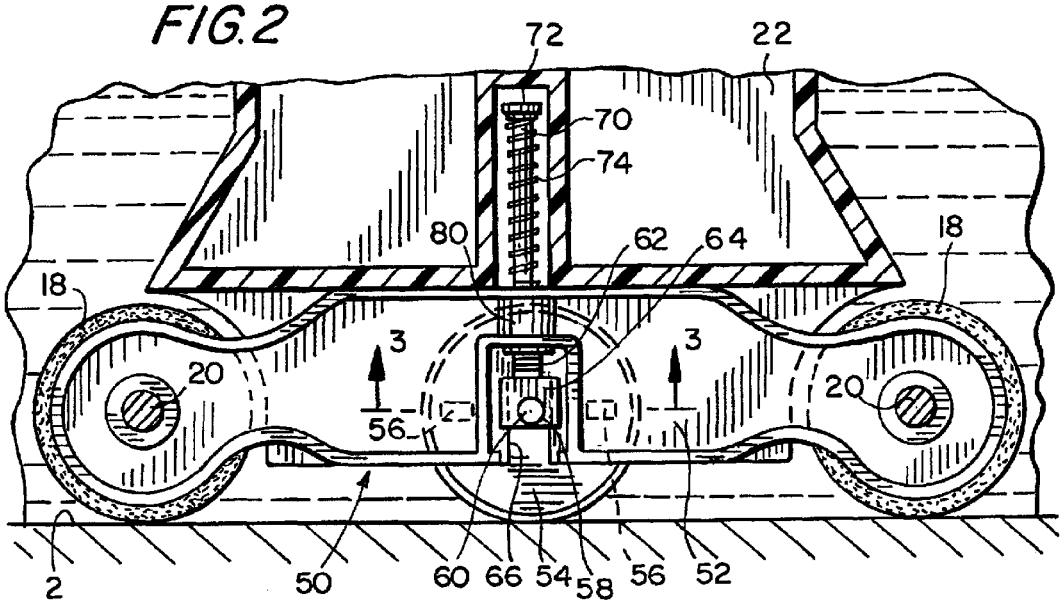
FIG. 2 is a side elevational view, partly in section showing a preferred embodiment of the motion sensing apparatus of the invention.
Figure 5:
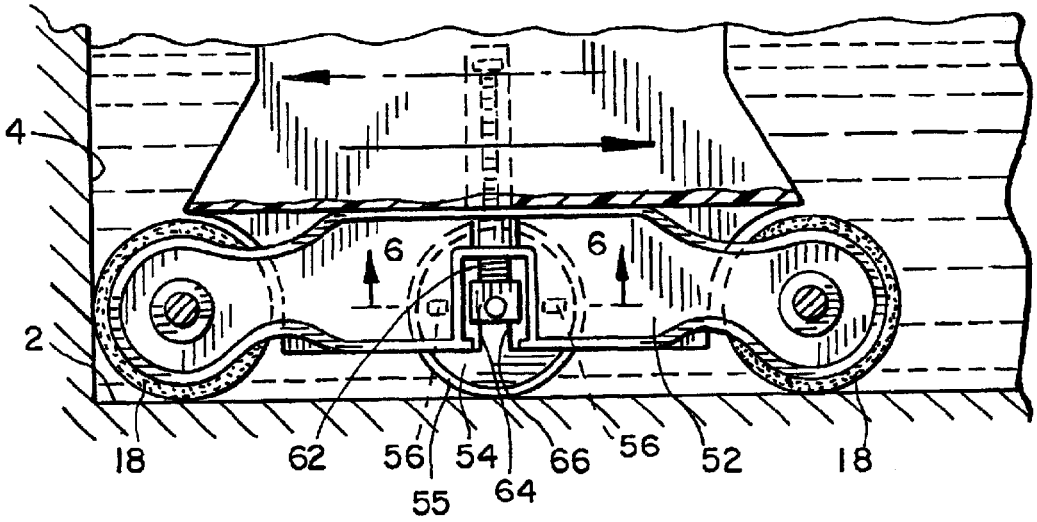
FIG. 5 is a side elevational view similar to FIG. 1 schematically illustrating the method of the invention for changing the direction of the cleaner.
Figure 6:
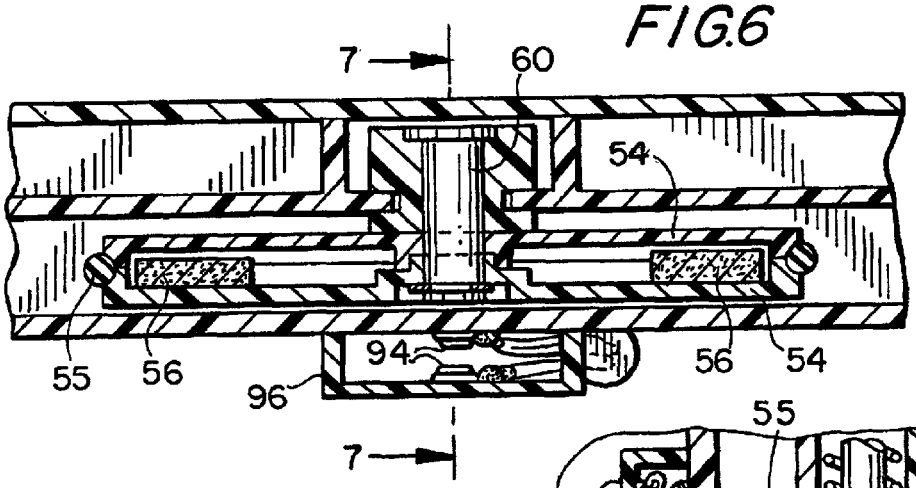
FIG. 6 is a partial section bottom view taken along line 6—6 of FIG. 5.

In a preferred embodiment illustrated in FIGS. 2–9, the wheel 54 embodying the mtm is provided with two rare earth permanent magnets 56 of the type known to produce a strong localized magnetic force field. As shown in FIG. 2, the two magnets 56 are advantageously mounted equidistant from each other at diametrically opposed positions at the periphery of the wheel 54 so as to rotate with the wheel 54. The magnets 56 can be mounted conveniently in corresponding recesses at the periphery of the wheel 54 and held in place with a water and chemical resistant epoxy compound or other known potting composition.

This preferred embodiment uses two magnets 56 spaced apart such that the magnetic field proximate to each magnet 56 is substantially greater than the magnetic field adjacent the wheel 54, but distant from the magnets 56, e.g., halfway between the magnets 56 around the periphery of the wheel 54. The spacing is determined such that the difference between the two magnetic field strengths can be detected by a sensor assembly 90 including a sensor such as reed switch 91. As best seen in FIGS. 3, 4, 7 and 9, the sensor assembly 90 is mounted in a waterproof housing 88 formed on a wall of support 52 and located facing the rotating wheel 54. The reed switch 91 itself is a conventional element including two opposed arms 92 each carrying a contact 94. In its conventional operation, when the reed switch 91 is not in the presence of a magnetic field of a defined strength, the arms 92 with the contacts 94 thereon stand separated by a gap. However, in the presence of a suitable magnetic field, the arms 91 are drawn together until the contacts 94 meet to close a circuit including the reed switch 91 and thereby provide an output on electrical leads 96 to the programmable control device.

Figure 7:
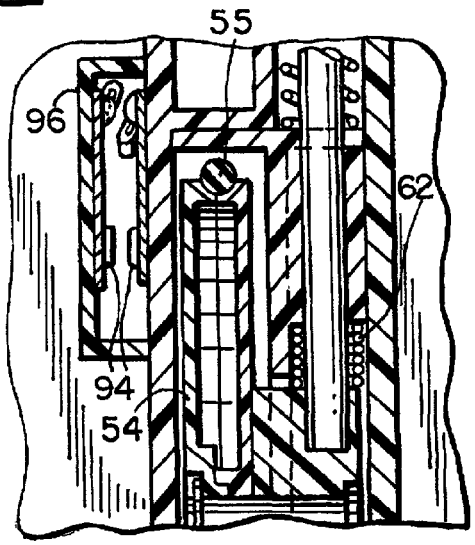
FIG. 7 is partial elevational view taken along line 7—7 of FIG. 6.
Figure 8:
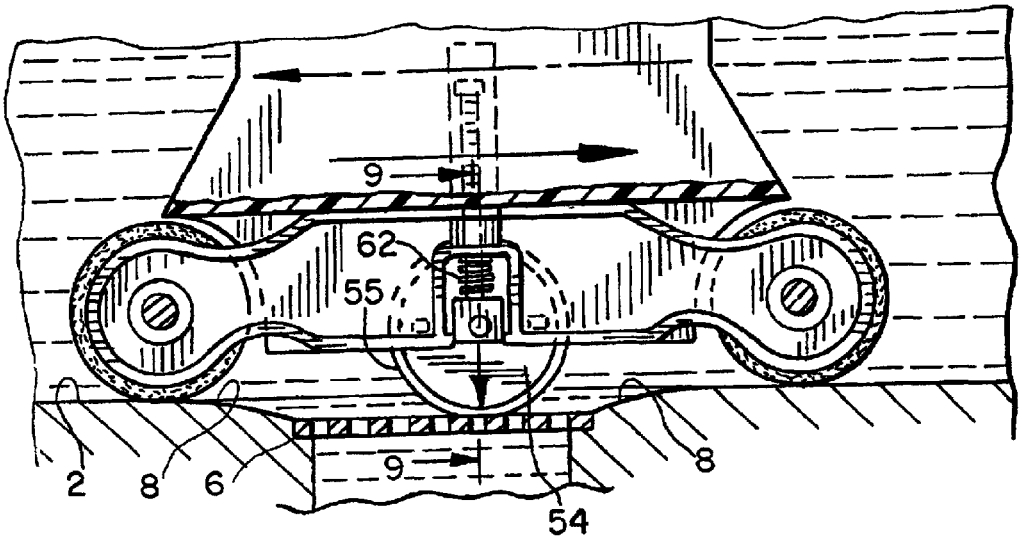
FIG. 8 is a side elevational view similar to FIG. 1 illustrating the method of operation of the invention when the cleaner passes over a section of uneven wall.

In the illustrated embodiment, the magnetic field experienced by the reed switch 91 increases and decreases twice with each rotation of the wheel 54. As the wheel 54 rotates to bring one of the magnets 56 proximate to the reed switch 91, as shown in FIG. 4, the magnetic field increases to bring the contacts 94 together to close the circuit. However, after another quarter turn of the wheel 54, both magnets 56 are distanced from the reed switch 91 and the magnetic field at the reed switch 91 decreases to allow the arms 92 to separate, opening the circuit as shown in FIG. 7. Thus, as the pool cleaner 10 moves normally across the pool wall, the reed switch 91 will receive a strong magnetic field twice at regular intervals for each complete rotation of the wheel 54. Each strong magnetic field is a signal transmitted from the respective magnet 56 in accordance with movement of the wheel 54 to be received by the reed switch 91. As a result, the reed switch 91 opens and closes at these intervals, thereby generating an output indicative of the signals received by the reed switch 91. If such signals (sufficiently high magnetic fields in this embodiment) continue to be received at these intervals, then the wheel 54, and hence the pool cleaner 10, is moving normally and the output of the reed switch 91 will so indicate.

However, if these signals are not generated at the expected intervals, some misoperation of the pool cleaner 10 is happening. In particular, and assuming that no element of the pool cleaner has malfunctioned, if no signal is generated over the interval, then the wheel 54 is not rotating normally to bring one of the magnets 56 timely into proximity with the reed switch 91. This situation may arise if, for example, the pool cleaner 10 is trapped in a corner of the pool or blocked by an object that has fallen into the pool. To detect this situation, a prescribed time period is set during which at least one signal should be transmitted from the signal transmitter carried by wheel 54 to the reed switch 91. Advantageously, this time period is longer than the expected interval between signals, to allow for a brief interruption in motion. In a preferred embodiment, with wheel 54 being 3 inches in diameter and the pool cleaner 10 moving at a conventional speed, the prescribed time period can be 5 seconds. If the output from the reed switch 91 to the programmable control device does not include an indication that a high magnetic field signal was received by the reed switch 91 for 5 seconds, then the output also indicates that the pool cleaner 10 has not moved within this prescribed period of time.

It is possible that the pool cleaner 10 will stop moving with one of the magnets 56 proximate to the reed switch 91, so that the high magnetic field signal is constantly received by the reed switch 91 and the contacts 94 remain closed in constant contact. The output of the reed switch 91 under this condition also indicates that the pool cleaner 10 has not moved within the prescribed period.

When the programmable control device receives an output indicating that the pool cleaner 10 has not moved within the prescribed period, it can take corrective action. Advantageously, this includes changing the direction of movement of the pool cleaner 10 from the direction it had before it stopped. If the direction is reversed, this enables the pool cleaner 10 to back away from an obstacle or out of a corner, and the pattern of movement can then be resumed.

If the change in direction of movement still fails to bring about movement of the wheel 54 and thereby indicating movement of the pool cleaner 10, the wheel 54 may be jammed with debris. In such case, a fall-back error operation can be used, such as shifting to a standard routine for the pool cleaning pattern. This change in pattern would be obvious to the individual responsible for the maintenance of the pool and operation of the pool cleaner 10, who is then alerted to a condition that must be corrected. In this way, any problem with the operation of the wheel 54 will result in the disabling of that particular part of the program with a transition to a standard program such as that well known in the art.

While the above-discussed embodiment employs two magnets 56, it will be understood that more magnets or only one magnet can be used instead. However, it is necessary that the number of magnets be chosen in consideration of the size of the wheel 54 so that the magnetic field changes sufficiently as the wheel 54 rotates to cause the reed switch to open and close.

Furthermore, while the above-discussed embodiment employs magnets as a signal transmitter and a reed switch as a sensor, other signal transmitter/sensor combinations can be used. For example, the signal transmitter can be constructed as a light emitting element that intermittently transmits light and the sensor can then be a photoelectric cell. In a preferred embodiment, the photoelectric cell is mounted on the wall of support 52 in place of the reed switch 91 and the light element includes a modified version of wheel 54 and a light source fixed on the pool cleaner at a position opposed to the photoelectric cell. The modified wheel includes at least one portion that transmits light and at least one portion that blocks passage of light so that rotation of the modified wheel interrupts light received by the photoelectric cell from the light source. Accordingly, as the modified wheel rotates, the photoelectric cell receives light signals transmitted from the modified wheel and provides an output indicative of the signals received. This output contains the same information as the output in the previously-discussed embodiment and can be used by the programmable control device in the same way. As will be understood by one skilled in the art, the light emitted can be in the visible spectrum, including from a laser source, or in the non-visible spectrum.

Figure 9:
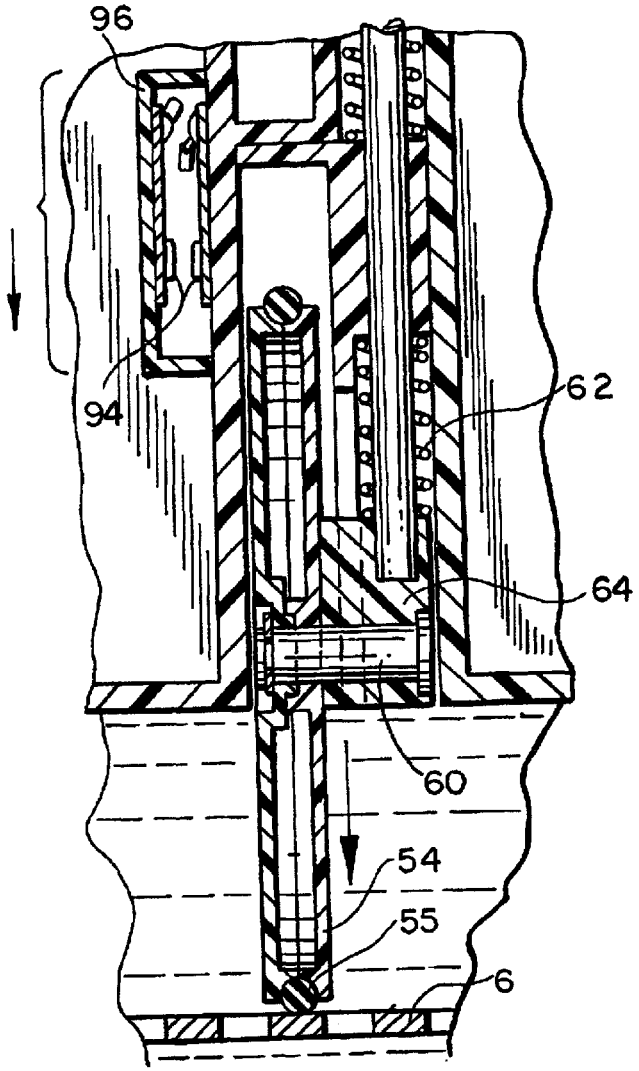
FIG. 9 is partial elevational end view taken along line 9—9 of FIG. 8.

In an especially preferred embodiment that will be described with reference to FIG. 9, the wheel 54 is so mounted in the supporting assembly 50 that it can be withdrawn sufficiently from the pool cleaner housing that the mounting clip 61 is exposed for removal from wheel axle 60 to thereby permit the wheel to also be dismounted from the axle. Removal of the wheel may be necessary to replace the traction surface 55, a wheel bearing (not shown), or the entire wheel. In the embodiment, slide block 64 can be displaced from channel 66 by pulling on the exposed rim of wheel 54 until cap 72 on shaft 70 completely compresses rebound spring 74. After the wheel has been replaced on axle 60, rebound spring 74 expands to raise shaft 70 and associated slide block 64 into channel 66 until block 64 encounters the resisting opposite force of biasing spring 62. As will be understood by one of ordinary skill in the art, shaft 70 can be short-ended and spring 74 omitted to provide a limited degree of vertical movement to slide block 64, and thereby to axle 60 and wheel 54. However, it will also be understood that such an arrangement will necessitate the disassembly of major components of the cleaner should it become necessary to replace the wheel.

In a preferred embodiment illustrated in FIGS. 2–9, wheel 54 is provided with at least two rare earth permanent magnets 56 of the type known to produce a strong magnetic force field. The magnets can conveniently be mounted in corresponding recesses in the region of the wheel between the axle bearing and periphery and held in place with a water and chemical resistant epoxy compound or other known potting composition. The plurality of magnets are mounted equidistant from each other, a pair preferably mounted at diametrically opposed positions.

As best shown in FIGS. 3, 4, 7 and 9, a sensor assembly 90, in the form of a reed switch 91 is mounted in a waterproof housing 88 formed on a wall of support 52 and proximate rotating wheel 54. In this embodiment, the proximity of one of the magnets 54 to switch 91 will cause arms 92 to move relatively closer to each other until contacts 94 meet to close the circuit; if the magnet moves away from the switch, the field is reduced and the contacts 94 part opening the circuit. As best shown in FIG. 3, electrical leads 96 contained in cable 98 are attached to the cleaner's programmable control device, e.g., a computer chip (not shown), which has been programmed to maintain the directional movement of the drive means so long as iii intermittent signal is received from the reed switch 91. In the event that the contacts 94 remain open or closed for a period of time that exceeds the predetermined, programmed time period, e.g., five seconds, the control device will alter the direction of movement of the cleaning apparatus.

It will also be understood that when the mtm is a continuous belt, one of the pulleys or sprockets can be constructed in the same manner as the wheel of FIG. 2. Its rotational movement will be caused by the passage of the belt, so long as the cleaner is moving normally in its cleaning pattern.

Other constructions can be employed without departing from the general method and apparatus of the invention described above. A further embodiment is illustrated schematically in FIG. 10 where the motion translating member 54 containing magnets 56 is displaced from the surface of the pool wall to an alternative position on the interior of the pool cleaner housing. The sensor 90 is positioned proximate wheel 54 in accordance with the embodiment described above in connection with FIGS. 2–9. The linear movement of the pool cleaner is translated to a rotational motion by auxiliary wheel 54A which is linked to wheel 54 by belt 78. The belt extends below the cleaner body 22. In the embodiment illustrated in FIG. 10, belt 78 is in contact with surface 2 and wheels 54 and 54A are preferably configured as pulleys or sprockets. Alternatively, the belt 78 can be recessed in a groove in the surface of the wheels 54 and 54A, or fixed to ride on a contiguous concentric portion formed for that purpose, in which case the rim of wheel 54A will contact surface 2 directly.

In order to assure appropriate tension in the belt 78, an idler wheel assembly 82 can be provided with idler wheel 84 urged into contact with the surface of belt 78 intermediate wheels 54 and 54A. The idler wheel provides for the tensioning of the belt when the spring-mounted lower sprocket moves from its customary position in order to accommodate irregularities in the wall being cleaned. The mounting of idler wheel assembly 82 and its component parts are comparable to that previously described and will be well known to those of ordinary-skill in the art.

Figure 10:
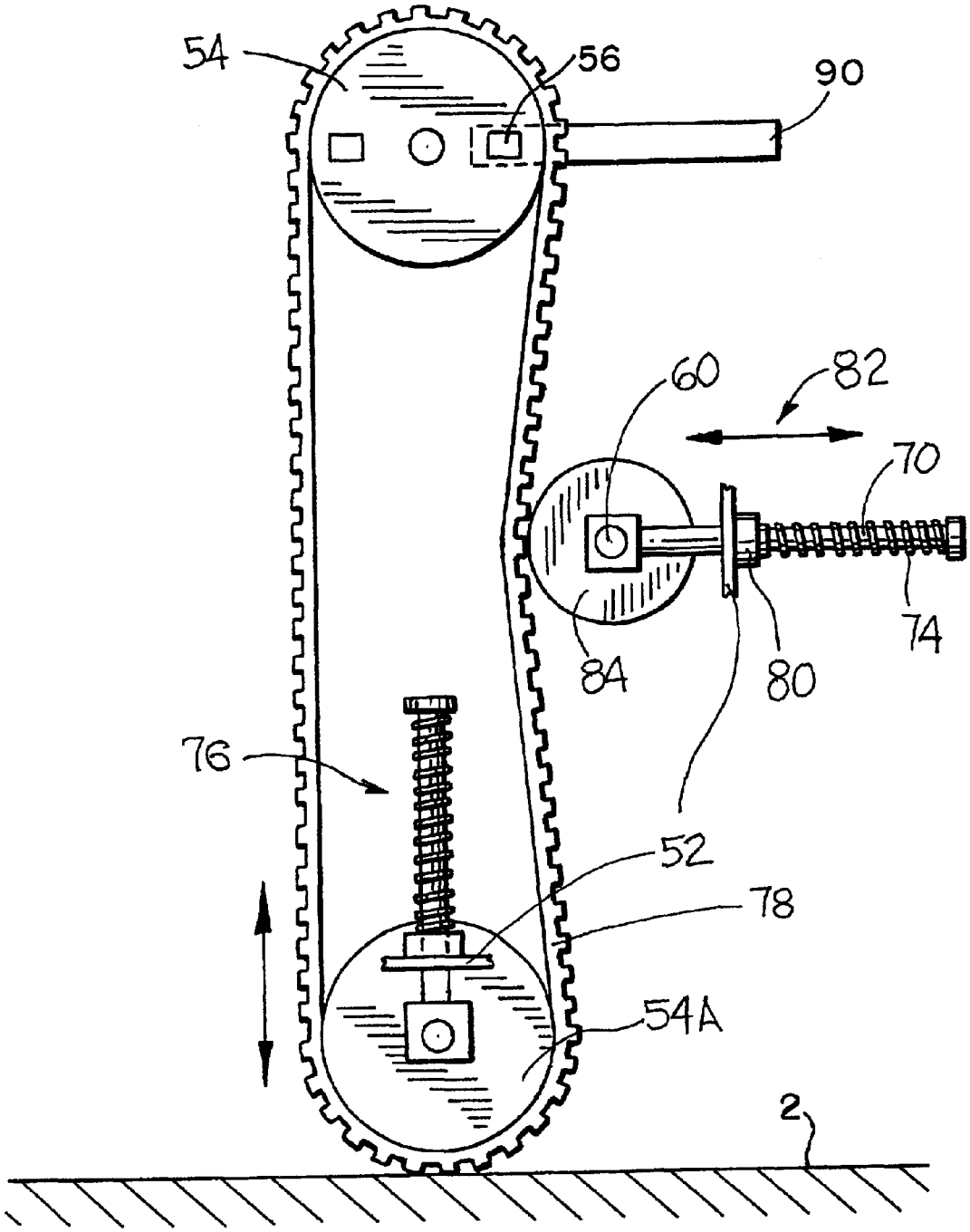
FIG. 10 is a side elevational view schematically illustrating another embodiment of the invention.

In the method of operation of the embodiment of FIG. 10, movement of the pool cleaner causes belt 78 to advance thereby rotating wheels 54 and 54A. Should wheel 54A experience a change in its vertical position with respect to the housing frame member 52, the idler wheel 84 will move in order to maintain the necessary tension to keep belt 78 in rotational contact with wheel 54. As and when the pool cleaner stops moving, belt 78, or auxiliary wheel 54A, will also stop moving. Absent the rotational force of belt 78, wheel 54 and magnets 56 will also cease their rotational movement. Sensor 90 will communicate this condition to the programmable control device and the predetermined change in the directional movement of the cleaner's drive mechanism wilt be effected by whatever mechanical means are provided for this purpose.

In yet a further variation on this embodiment, belt 78 can be provided with transmitters in the form of a plurality of magnetic elements (not shown) that are spaced apart along the length of the belt. The magnetic elements can be molded into the body of the flexible polymeric belt 78, or attached to its surface, e.g., in recesses. As the belt passes the sensor 90, or ceases its movement, the same effect is achieved as described in the earlier embodiments, with the direction of movement of the pool cleaner being altered.

As will be apparent from the above described embodiments, numerous other changes to the specific structure employed to effect the translation of the linear movement of the cleaner into a rotational movement, which rotational movement results in the corresponding movement of a signal transmitter pasta sensor that detects the absence and/or periodic presence of the transmitter in order to determine whether the cleaner is actually moving with respect to the surface of the pool, or such relative movement has ceased, regardless of whether the cleaner drive means is still activated. Such movement can also be translated by one or more gear sets attached to wheels, rollers, belts or other traction devices that will consistently move without slipping to reliably indicate when the cleaner is moving with respect to the wall of the pool that is being cleaned.

The foregoing description of a preferred embodiment and best mode of the invention known to applicants at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims that follow.

I claim:

1. An automated power-driven pool cleaning apparatus utilized for cleaning the surface of a bottom or side wall of a pool or tank and including a programmable control device for directing movement of said apparatus across the wall, said apparatus comprising:

a motion translating member mounted for contacting the surface of the wall being cleaned, said motion translating member moving as said apparatus moves across the surface;

a signal transmitter for transmitting signals in accordance with movement of said motion translating member; and a sensor mounted to receive signals from said signal transmitter and for providing an output indicative of signals received to the programmable control device, which is programmed to change a direction of movement of said apparatus when the output of said sensor indicates that said apparatus has not moved within a prescribed period of time, wherein said signal transmitter is responsive to normal movement of said motion translating member to transmit at least one signal during each unit of time equal in duration to the prescribed period of time, and wherein the output of said sensor indicates that said apparatus has not moved within the prescribed period of time when no signal is received by said sensor within the prescribed period of time.

2. The apparatus of claim 1, wherein the output of said sensor indicates that said apparatus has not moved within the prescribed period of time when a signal is constantly received by said sensor for the prescribed period of time.

3. The apparatus of claim 1, wherein said motion translating member includes a wheel mounted for rotation on an axis transverse to the direction of movement of said apparatus.

4. The apparatus of claim 3 wherein a portion of said wheel in contact with the surface of the wall is provided with a traction surface.

5. The apparatus of claim 4, wherein said traction surface is a polymeric material having a high coefficient of friction.

6. The apparatus of claim 1, wherein said motion translating member includes a wheel that rotates as said apparatus moves across the wall, said signal transmitter being mounted on said wheel to move as said wheel rotates.

7. The apparatus of claim 6, wherein said signal transmitter is mounted to rotate with said wheel.

8. The apparatus of claim 7, wherein said signal transmitter is mounted on said wheel at a periphery of said wheel.

9. The apparatus of claim 7, wherein said sensor is mounted on said apparatus at a position where said sensor receives or does not receive a signal from said signal transmitter in dependence upon a rotational position of said wheel.

10. The apparatus of claim 9, wherein said sensor is mounted on said apparatus at a position that said signal transmitter is alternately proximate to and distanced from as said wheel rotates, said sensor receiving a signal from said signal transmitter when said signal transmitter is proximate to said sensor, and said sensor not receiving a signal from said signal transmitter when said signal transmitter is distanced from said sensor.

11. The apparatus of claim 10, wherein said signal transmitter includes at least one permanent magnet mounted at said periphery of said wheel.

12. The apparatus of claim 11, wherein said sensor includes a reed switch that moves between an open and a closed position in dependence upon whether said at least one permanent magnet is proximate to or distanced from said reed switch.

13. The apparatus of claim 12, wherein said wheel is sized such that said at least one permanent magnet is proximate to said reed switch at least once during each unit of time equal in duration to the prescribed period of time during normal movement of said motion translating member to transmit at least one signal, and wherein the output of said sensor indicates that said apparatus has not moved within the prescribed period of time when no signal is received by said sensor within the prescribed period of time.

14. The apparatus of claim 13, wherein the output of said sensor indicates that said apparatus has not moved within the prescribed period of time when a signal is constantly received by said sensor for the prescribed period of time.

15. The apparatus of claim 12, wherein said signal transmitter includes at least two permanent magnets mounted at said periphery in diametrically opposed relation to each other.

16. The apparatus of claim 1, further comprising a support assembly for urging said motion translating member into contact with the surface of the wall being cleaned.

17. The apparatus of claim 16, wherein said support assembly comprises a spring-biased shaft mounted for movement in a direction generally normal to the surface of the wall being cleaned, whereby said motion translating member is maintained in contact with irregularities in the surface.

18. The apparatus of claim 17, wherein said support assembly includes a mounting bracket for receiving said spring-biased shaft and a bearing surface for said motion translating member.

19. The apparatus of claim 18, wherein said motion translating member is a wheel and said bearing surface is an axle.

20. The apparatus of claim 18, wherein said motion translating member is a continuous flexible belt and said bearing surface comprises a plurality of rotationally-mounted pulleys.

21. The apparatus of claim 1, wherein said signal transmitter comprises a light element for intermittently transmitting light to said sensor.

22. The apparatus of claim 21, wherein said light element is responsive to normal movement of said motion translating member to transmit light to said sensor at least once during each unit of time equal in duration to the prescribed period of time, and wherein the output of said sensor indicates that said apparatus has not moved within the prescribed period of time when no light from said light element is received by said sensor within the prescribed period of time.

23. The apparatus of claim 22, wherein the output of said sensor indicates that said apparatus has not moved within the prescribed period of time when light from said light element is constantly received by said sensor for the prescribed period of time.

24. The apparatus of claim 21, wherein said light element includes a light source and means for intermittently transmitting light from said light source to said sensor.

25. The apparatus of claim 24, wherein said light source is fixed and said means for intermittently transmitting comprises at least one portion of said motion translating member that transmits light in spaced relation to at least one portion of said motion translating member that blocks passage of light, such that movement of said motion translating member interrupts light received by said sensor from said light source.

26. The apparatus of claim 1, wherein said signal transmitter is a light source and said sensor is a photoelectric cell.

27. The apparatus of claim 1, wherein the prescribed time is about five seconds.

* * * * *